United States Patent [19]

Kropielnicki et al.

[11] Patent Number: 4,761,826

[45] Date of Patent: Aug. 2, 1988

[54] SIGNAL SEPARATING DEVICE

[75] Inventors: Jerzy J. Kropielnicki, Knutsford, England; James D. Last; Brian Easter, both of Gwynedd, United Kingdom

[73] Assignee: BSH Electronics, Ltd., Manchester, England

[21] Appl. No.: 845,464

[22] Filed: Mar. 28, 1986

[30] Foreign Application Priority Data

Mar. 30, 1985 [GB] United Kingdom ..... 8508402

[51] Int. Cl.[4] ..... H01Q 1/02; H01Q 1/32

[52] U.S. Cl. ..... 455/277; 343/704; 343/713

[58] Field of Search ..... 343/711–713, 343/704; 455/277, 345, 270, 280, 297, 10, 279

[56] References Cited

U.S. PATENT DOCUMENTS

| | | | |
|---|---|---|---|
| 3,484,584 | 12/1969 | Shaw, Jr. | 343/711 |
| 4,095,228 | 6/1978 | Meinke et al. | 343/712 |
| 4,422,077 | 12/1983 | Kropielnicki | 343/713 |
| 4,439,717 | 3/1984 | Kume et al. | 343/713 |

FOREIGN PATENT DOCUMENTS

| | | | |
|---|---|---|---|
| 0042402 | 4/1981 | Japan | 343/711 |
| 0044201 | 4/1981 | Japan | 343/711 |
| 0042401 | 4/1981 | Japan | 343/711 |
| 0154904 | 9/1982 | Japan | 343/711 |

*Primary Examiner*—Robert L. Griffin
*Assistant Examiner*—Curtis A. Kuntz
*Attorney, Agent, or Firm*—Shoemaker and Mattare, Ltd.

[57] ABSTRACT

The present invention provides diversity reception to effectively compensate for signal reception fading without using separate antenna structures and while using the heating element antenna of an electrically heated window of a motor vehicle. Such is accomplished by providing common (unbalanced) and balanced signal separation configurations and signal selection circuitry between the heating element antenna and the VHF aerial input terminal of a vehicle radio receiver, wherein the signal selection circuitry selectively connects the signal outputs of the common and balanced signal separation configurations to the VHF aerial input in dependence on monitored characteristics of the radio signals produced at these outputs and received by the vehicle radio receiver.

8 Claims, 3 Drawing Sheets

SIGNAL SEPARATING DEVICE

This invention relates to a signal separating device for separating a radio signal from the heating element of an electrically heated window of a motor vehicle whereby the heating element can be used simultaneously for heating purposes and as a radio transmitting or receiving aerial.

Our British Patent Nos. 1,520,030, 1,600,987 and British patent application No. 2152760 describe various signal separating devices incorporating isolating and matching circuitry which acts to isolate the power supply circuit for the heating element from the aerial circuit of a radio receiver or transmitter connected to the heating element, and which also acts to match the RF characteristic of the heating element to the aerial circuit, such heating element being essentially aperiodic and non-resonant at the frequencies of use especially in VHF applications.

A well recognised problem with vehicle VHF radio receiving equipment is that, when the vehicle is in motion, the signal is subject to momentary, deep fast fades due to multipath propagation by reflection and diffraction of the signal by nearby objects and local features such as hills, buildings, other vehicles etc. With the aim of overcoming this problem it is known to use a technique referred to as diversity reception. With one known arrangement two aerials are provided at spaced positions on the vehicle and an electronic circuit is used to switch the receiving equipment between the two aerials. The electronic circuit is responsive to the strength of the signal received via the aerial to which the receiving equipment is initially connected whereby the equipment is switched to the other aerial in the event that the signal strength falls below a predetermined value. If both aerials provide weak signals the electronic circuit continually compares both signal strengths and selects the aerial with the stronger signal until the signal strength of one aerial rises above the predetermined threshold value. The success of this technique relies on the ability to arrange the aerials so that there is a low likelihood of fading occurring in both aerials simultaneously. Thus, the aerials may be located at positions on the vehicle which are spaced sufficiently to ensure that it is likely that they are exposed to radio signals which are significantly differently modified e.g. respectively at the front and back of a motor vehicle.

An object of the present invention is to provide an aerial arrangement whereby fading can be effectively compensated using a diversity reception technique which does not necessitate the use of separate aerial structures.

According to the invention therefore there is provided a signal separating device for separating a radio signal from the heating element of an electrically heated window of a motor vehicle comprising a first electrical connection arrangement for connection to the heating element, a second electrical connection arrangement for connection to an aerial circuit of radio equipment, said second connection arrangement being linked to said first connection arrangement, and isolating circuitry for isolating radio signals at said first connection arrangement from electric power fed to the heating element for heating purposes, characterised in that said second electrical connection arrangement comprises at least two radio signal connections which are linked to said first electrical connection arrangement by separating circuitry arranged to establish with the heating element and the respective connections different respective aerial arrangements responsive to radio signals in different respective configurations.

With this arrangement it is possible to achieve effective compensation for adverse signal modification, particularly fading, in a simple and convenient manner.

The connection to the heating element may be effected via a common arrangement for the different configurations whereby appropriate operation of the separating circuitry is required in association with the said radio signal connections to distinguish between the different signal configurations. Thus, in one embodiment, two leads are connected to opposite positions on the heating element (e.g. the positive and negative power terminals) and said separating circuitry includes a suitable distinguishing circuit which is used to separate balanced and unbalanced aerial configurations. For example this distinguishing circuit may comprise a transformer with a centre-tapped winding connected at its ends via the two leads to the heating element, one of the said radio signal connections being derived from the centre tap and a further said radio signal connection being derived from a further, inductively coupled winding of the transformer. With this arrangement, the signal fields associated with the two aerial configurations may be orthogonally disposed whereby, advantageously, minimum correlation between the two fields can be achieved.

Alternatively there may be multiple connections respectively to different parts of the heating element which multiple connections are linked by the separating circuitry to the radio signal connections whereby the different signal configurations are derived as a consequence of the different arrangements and/or orientation and/or spatial disposition of such parts.

With regard to the isolation circuitry this may take any suitable form. Thus a bifilar winding or other arrangement as described in U.K. Patent Nos. 1,520,030, 1,600,987 or U.K. patent application No. 2152760 may be used. Also, matching circuit for matching the aerial arrangement in each said configuration to the aerial circuit of the radio equipment may be provided, suitable such circuitry being described in the abovementioned U.K. Patents and pending application.

The radio signal connections may be arranged to be linked to the aerial circuitry of the radio equipment by selection circuitry which is operable to selectively connect the said electrical connections to the said aerial circuit in dependence on monitored characteristics of radio signals in the different configurations of the aerial arrangement. Suitable such circuitry is used in conventional diversity reception arrangements. The selection circuitry may be incorporated in the signal separating device or may be incorporated in the radio equipment.

In accordance with an alternative embodiment, the radio signal connections may be arranged to be linked to the aerial circuitry of the radio equipment by a switching arrangement which repeatedly links the connections alternately to the aerial circuitry for example at a predetermined switching frequency. This switching arrangement may be incorporated in the signal separating device or the radio equipment.

In accordance with a further embodiment, the connections are arranged to be joined in two different modes i.e. directly and indirectly via a delay line (e.g. a length of coaxial cable), so that two different polarisations result. In particular, in this embodiment, the delay line is arranged to be a quarter wavelength thus giving a phase shift of 90°. This results in a vector summation of the two signals with a 90° phase difference. Switching between the two different modes may be effected in accordance with monitored signal characteristics or at a predetermined switching frequency as mentioned above. The mixing and switching circuitry may be incorporated in the separating device or in the radio equipment.

The above three embodiments may be combined with each other in any combination as appropriate. It is visualised that the separating device of the invention will find particular application in the context of reception of VHF radio signals using the heated rear window of a motor car as the receiving aerial, such heated rear window being essentially aperiodic and non-resonant at the VHF frequencies of use. It is however to be understood that the invention is not restricted to this field of application but may be utilised with any suitable heating element or combination of heating elements on any window or windows of any suitable kind of vehicle for receiving and/or transmitting purposes whether in the context of broadcasting or communications.

The invention will now be described further by way of example only and with reference to the accompanying drawings in which.

The signal separating device 1 comprises a housed circuit arrangement which is mounted in a motor car closely adjacent a heated rear window 2 of the car. The housing is indicated at 40.

Figure 1:
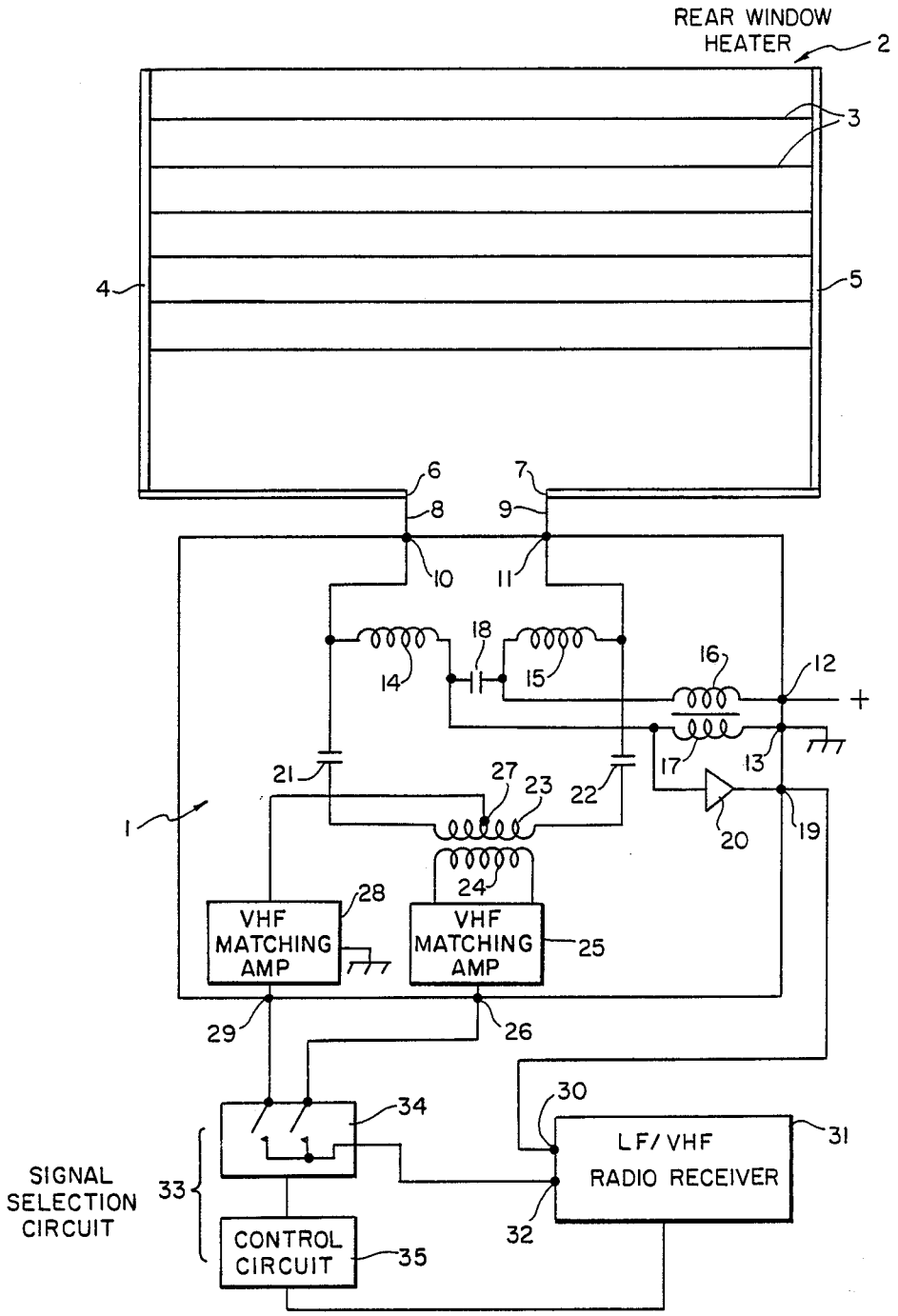
FIG. 1 is a circuit diagram of one form of a signal separating device according to the invention.

As shown in FIG. 1, the heated rear window 2 may have a plurality of parallel horizontal heating wires 3 linked at each end to vertical power bus bars 4, 5. The bus bars are extended downwardly and terminate at positions 6, 7 centrally of the heating arrangement. The bus bars 4, 5 are connected by leads 8, 9 to input connections 10, 11 of the separating device 1 and the device 1 is positioned immediately beneath the bus bar terminations 6, 7 thereby giving a spatially symmetrical balanced layout of the heating arrangement and the separating device 1. Within the separating device 1, the input connections 10, 11 are linked to power supply connections 12, 13 via two separate chokes 14, 15 and bifilar windings 16, 17 of the kind described in U.K. Patent No. 1,520,030. The chokes 14, 15 are joined by a capacitor 18 and one of the chokes 14 is connected to a LF (low frequency) output connection 19 via a buffer amplifier 20.

The input connections 10, 11 are also linked, via capacitors 21, 22 to a primary winding 23 of a transformer and an inductively linked secondary winding 24 is connected via a VHF matching amplifier 25 to a first VHF output connection 26. A centre tap 27 of the primary winding 23 is connected via a second VHF matching amplifier 28 to a second VHF output connection 29.

The power supply connections 12, 13 are linked to the battery circuit of the car via the usual heater switch (not shown). The LF output connection 19 is linked to the LF aerial input 30 of a LF/VHF radio receiver 31 in the car.

The VHF output connections 26, 29 are linked to the VHF aerial input 32 of the radio receiver 31 via a signal selection circuit 33.

The signal selection circuit is as conventionally used in diversity reception and comprises two switches 34 (e.g. PIN diodes) respectively linking the VHF output connections 26, 29 with the VHF aerial input 32, and a control circuit 35 connected on the one hand to the switches 34 to control the switching thereof and on the other hand to a point within the receiver 31 at which a measure of the amplitude of the signal or the intensity of the multipath interference may be obtained.

With this arrangement, referring to VHF reception, the two outputs 26, 29 provide VHF signals derived from different reception configurations or aerial configurations of the heating element—namely a VHF signal from a balanced configuration at output 26 and a VHF signal from an unbalanced (common mode) configuration at output 29. The two configurations have optimum responses respectively to different orthogonal fields whereby there is a minimum fading correlation between the configurations, it being understood that fading is generally accompanied by polarisation change. That is, if fading is experienced by one configuration there is a high likelihood that substantially no fading will be experienced by the other configuration.

Initially the switches 34 are controlled so that one of the FM outputs 26 or 29 is connected to the aerial input 32. If the signal received fades and the output from the IF system in the radio receiver 31 falls below a threshold value, the switch positions are reversed and the other VHF output 26 or 29 is connected to the aerial input 32. If the signals from both VHF outputs 26, 29 are weak these are compared and the VHF output providing the stronger signal is selected. The comparison procedure is continually repeated until one of the VHF outputs is again above the threshold value.

The two matching circuits 25, 28 are appropriately designed to match respectively the balanced and unbalanced configurations of the aerial arrangement.

With the above described embodiment effective compensation for fading can be achieved with a particularly simple and convenient construction.

Figure 2:
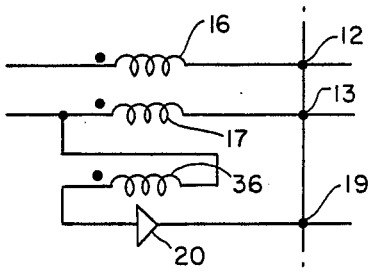
FIGS. 2–4 show different modifications of parts of the circuit of FIG. 1.

FIG. 2 shows a modified arrangement of the bifilar winding. A further coil 36 is incorporated to give a boosted output which is fed to the amplifier 20. This gives an improved LF signal. The improvement may be of the order of 5 to 10 dB.

Figure 3:
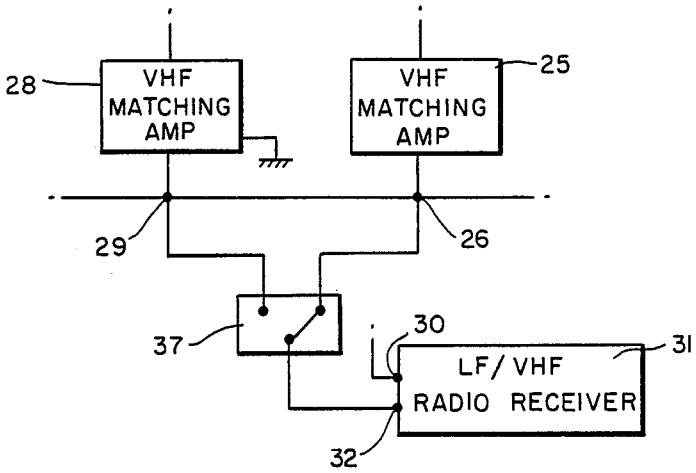

FIG. 3 shows a modified arrangement of the selection circuitry in which the two outputs 26, 29 are connected to the input 32 via a switching circuit 37. The switching circuit simply switches between the two outputs connecting them alternately to the input 32 at a set frequency (say of the order of Kilohertz).

Figure 4:
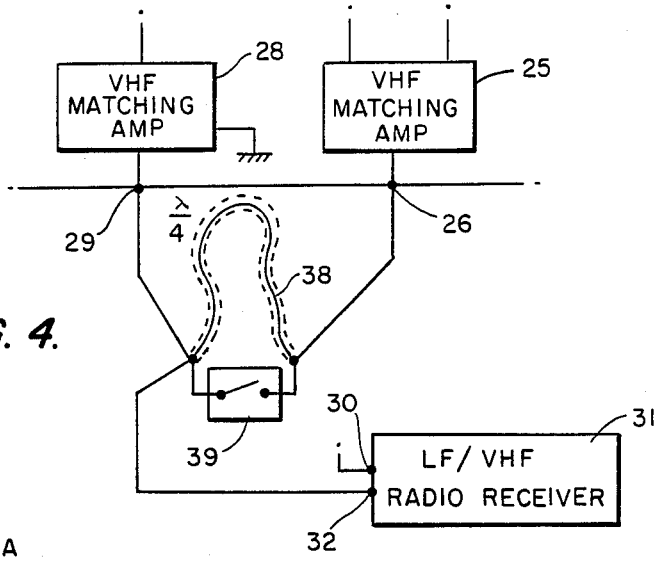
Figure 5:
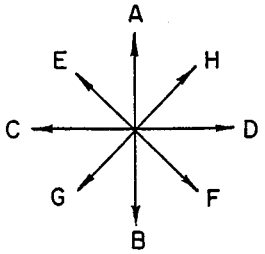
FIG. 5 is a diagram showing different polarisations of aerial configurations with the circuits of FIGS. 1 to 4.

FIG. 4 shows a further modified arrangement of the selection circuitry in which the two outputs are connected together by a length of coaxial cable 38 which establishes a quarter wavelength delay line, and a switch 39. The switch is opened and closed at a set frequency (say of the order of Kilohertz). The signal fed to the input 30 constitutes a mixture of the signals at the outputs 26, 29 in two different modes i.e. at orthogonal polarisations at angles which differ from the orthogonal polarisations obtained with the arrangement of FIG. 3, e.g. polarisations alternating between EF and GH rather than AB and CD as shown in FIG. 5. That is, the delay line is arranged to be a quarter wavelength thus giving a phase shift of 90° and this results in a vector summation of the two signals with a 90° phase difference.

The arrangements of FIGS. 3 and 4 can be combined so that all four polarisations of FIG. 5 are utilised in any desired sequence.

Figure 6:
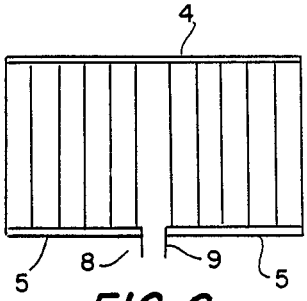
FIGS. 6–8 show alternative heating element patterns.
Figure 7:
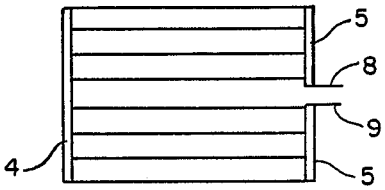
Figure 8:
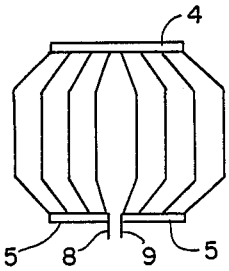

FIG. 1 shows a simplified window heating element with a centralised arrangement of connection leads 8, 9. In practice different heating element configurations are possible and the leads 8, 9 may be arranged off centre or asymmetrically as required for convenient location of the device. Suitable configurations are shown in FIGS. 6 to 8. The bus bars 4, 5 and wires 3 may be vertical or horizontal or otherwise disposed. Most preferably a "folded" arrangement with a split bus bar 5 is used since this permits the use of short bus bar connections to the leads 8, 9.

Some or all of the separation/switching circuitry interposed between the outputs 26, 29 and the input 32 may be incorporated in the housing of the radio equipment 31 or in the housing of the signal separating device 1, or in a separate intermediate housed unit.

We claim:

1. A signal separating device for separating radio signals from the heating element antenna means of an electrically heated window of a motor vehicle comprising:

common (unbalanced) configuration signal separation circuit means connected between said heating element antenna means and one of at least two radio signal connections of the aerial inputs of a vehicle radio receiver;

isolating circuitry connected with the connection of said common (unbalanced) configuration signal separation circuit means to the said heating element antenna and with the other of said at least two radio signal connections of the aerial inputs of a vehicle radio receiver;

balanced configuration signal separation circuit means coupled with the said common (unbalanced) configuration and with said one of at least two radio signal connections;

signal selection circuit means selectively connecting the outputs of said common (unbalanced) and balanced configurations to the said one of at least two radio signal connections of the aerial inputs of a vehicle radio receiver in dependence on monitored characteristics of the radio signals produced at said outputs and received by said vehicle radio receiver;

wherein said signal separating device includes said circuit means to establish with said heating element antenna different respective aerial arrangements responsive to radio signals in different configurations, and whereby diversity reception is provided to effectively compensate for fading without using separate antenna structures.

2. A device according to claim 1 wherein said signal separating device includes distinguishing circuit means to separate balanced and unbalanced aerial configuration signals.

3. A device according to claim 2 wherein said distinguishing circuit means comprises a center-tapped transformer.

4. A device according to claims 1 or 2 or 3 wherein said signal selection circuit means comprises a switching arrangement which repeatedly links said outputs of the said common (unbalanced) and balanced configurations alternately to said one of at least two radio signal connections of the aerial inputs of a vehicle radio receiver.

5. A device according to claims 1 or 2 or 3 wherein said signal selection circuit means includes therewith a delay link and comprises a switchable direct link and selection circuitry to selectively open and close said switchable direct link in dependence on monitored characteristics of said radio signals produced at the said outputs.

6. A device according to claims 1 or 2 or 3 wherein said signal selection circuit means includes therewith a delay link and comprises a switchable direct link and means for repeatedly opening and closing said switchable direct link.

7. A device according to claim 1 wherein said one of at least two radio signal connections is the VHF aerial input.

8. A device according to claim 1 wherein said radio signals are orthogonally disposed with respect to each other.

* * * * *